United States Patent [19]

Shotbolt

[11] 4,386,659

[45] Jun. 7, 1983

[54] GUIDES FOR FORMING CONNECTIONS

[75] Inventor: Keith Shotbolt, London, England

[73] Assignee: Constructors John Brown Limited, England

[21] Appl. No.: 232,548

[22] Filed: Feb. 9, 1981

[30] Foreign Application Priority Data

Feb. 14, 1980 [GB] United Kingdom ..... 8005069

[51] Int. Cl.[3] ..... E21B 41/00

[52] U.S. Cl. ..... 166/342; 166/344; 166/350; 285/24; 285/DIG. 21; 405/169; 405/170

[58] Field of Search ..... 285/24, 27, DIG. 21; 166/341, 343, 344, 345, 349, 350, 342; 405/168, 169, 170, 171, 224

[56] References Cited

U.S. PATENT DOCUMENTS

| | | | |
|---|---|---|---|
| 3,967,462 | 7/1976 | DeJony | 285/27 |
| 4,133,182 | 1/1979 | Chateau | 285/24 |

FOREIGN PATENT DOCUMENTS

| | | | |
|---|---|---|---|
| 2288264 | 5/1976 | France | 405/168 |
| 1300771 | 12/1972 | United Kingdom . | |
| 1300772 | 12/1972 | United Kingdom . | |
| 1494926 | 12/1977 | United Kingdom . | |
| 2056009 | 3/1981 | United Kingdom | 166/342 |

OTHER PUBLICATIONS

Offshore Services, May 19, 1979, p. 2.

*Primary Examiner*—Dave W. Arola
*Attorney, Agent, or Firm*—Bacon & Thomas

[57] ABSTRACT

A guide for use in connecting a riser pipe to a subsea riser base comprises a guide post and an expanding mandrel actuable by hydraulic pressure applied through a cable having hydraulic hoses in its core to lock the mandrel in a subsea riser base. The guide post is provided with buoyancy means to reduce its effective weight in water to enable it to be manipulated and manoeuvred by a remote controlled vehicle or diver.

9 Claims, 3 Drawing Figures

GUIDES FOR FORMING CONNECTIONS

FIELD OF THE INVENTION

The present invention relates to a guide for use in forming an underwater connection between a tubular member and a subsea riser base.

BACKGROUND OF THE INVENTION

In the exploitation of undersea hydrocarbon reserves, it is frequently necessary to make a connection between a tubular member such as a riser pipe lowered from the surface and an existing riser base such as a well head.

One method for this is described in our earlier British Patent Application No. 7,928,006, now Pat. No. 2,056,009, which describes the use of a guide comprising a guide post with a hydraulic radially expandable end portion which is lowered through the tubular member, which is typically a riser pipe, on a cable with a hydraulic hose core to hang below the tubular member. A remote controlled vehicle (RCV) or diver then positions the guide so that its radially expandable portion is in the riser base where it is locked by hydraulic actuation of the radially expanding portion.

The riser pipe is then lowered, guided by the cable, to engage the guide post. As the pipe slips down over the guide post any angular misalignment is corrected by the guide post so that connecting members on the pipe and riser base are properly oriented for correction.

The guide previously described would typically weigh about 1000 lbs (454 Kg). The RCV's or divers employed to position this can move such a guide a small distance sideways as it hangs on its cable above the riser base but they cannot themselves lift the guide. It has now been appreciated that this may be generally somewhat disadvantageous but is especially so when the structure from which the tubular member and the guide are lowered is not itself fixed to the sea bed but are floating, for instance where the structure is a barge, ship or floating platform. Furthermore, there is a limit to the extent of sideways movement that can be achieved by an RCV or diver acting against the hanging weight of a guide as described above.

Large lateral offsets between the tubular member and riser base can be avoided using a fixed structure but are likely to be encountered in exploiting the proposed tethered buoyant platforms.

The first tethered buoyant platform (TBP) design contract was awarded in December 1979 and the oil industry will be able to evaluate this concept in prototype form by the mid 1980's. Floating production systems began with a semi-submersible rig having catenary mooring at Argyll field which came on stream in 1975. The advantages of the floating platform are their adaptability to deep water, and to marginal fields due to their mobility for re-use. These advantages have been known for at least five years but the excessive motions of the catenary moored system have delayed widespread application. Relative motions between riser and platform can be greatly reduced by the vertical tether system, see U.S. Pat. Nos. 3,780,685; 3,934,528, et al, and the engineering development of the first practical vertical tether system is under way.

Although vertical tethers reduce heave and pitch motions, they do not exercise the same restraint on lateral movement. Tether angles of 3° in 500 ft. depth and 1° in 2000 ft. depth will be fairly common. Even at ½°, the lateral offset in 500 ft. is 5 ft. and in 2000 ft. is 20 ft.

Drilling, production and sales risers must be run under these conditions, where a lateral offset of 20 feet between the top of a vertical riser and a seabed connection is likely.

Conventionally, drilling equipment is guided to the seabed by guide wires. Four wires are normally equally-spaced around a 12′ diameter pitch circle. On a tension leg platform, the minimum number of conventional guide wires required would equal the number of well slots, but this quantity would only provide two wires per well. These wires are tensioned, and this total load would need to be considered as extra deck loading, thereby reducing the useful equipment capacity. Permanently installed wires will corrode and need periodic replacement, which could lead to entanglement.

An alternative solution to the lateral offset problem is suggested by U.K. Pat. No. 1,462,401 which describes a tethered buoyant platform with inclusive dynamic positioning means. Thrusters allow the platform (a) to position itself directly above the subsea template and (b) to guide risers into alignment with subsea connection points.

These thrusters will be used infrequently and are very expensive to install.

It is desired therefore to provide means first to guide the end of a tubular member such as a suspended riser to a position above the connection point, and then to guide the lower end of the riser to bring its axis into alignment with the sea bed connection means.

BRIEF DESCRIPTION OF THE DRAWINGS

The present invention provides a guide for use in connecting a tubular member, e.g. a riser pipe to a subsea riser base, which guide comprises a guide post, having a reversibly radially expandable portion to locate in and rigidly attach the guide post to the subsea riser base, an elongate portion to be received in the end of the pipe, and buoyancy means to reduce the effective weight of the post underwater to a level at which it can be readily manipulated and manoeuvred. In use in installing a riser pipe, the guide will be chosen such that it is a sliding fit inside the riser. The buoyancy means will be chosen to permit easy manipulation and lateral movement by the subsea work system available, i.e. a diver, atmospheric diving suit, or remotely-controlled vehicle.

In use, the guide post will normally be suspended on a cable, usually attached on the axis of the guide and preferably providing a hydraulic connection to the guide when the expandable portion is hydraulically actuated.

Figure 2:
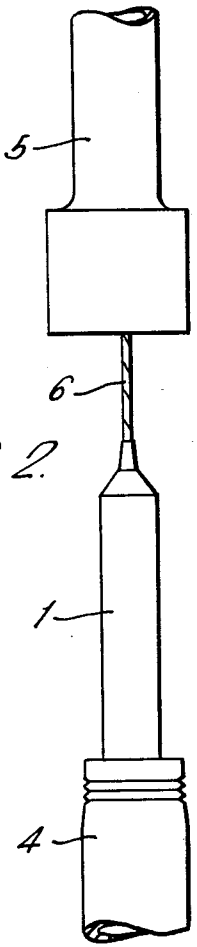

The expandable portion may be an expanding mandrel and the expanding mandrel will preferably be wholly or partially segmented and cooperate with wedging surfaces so that as the segments move over the wedging surfaces, the outside diameter either increases or decreases, depending on the direction of motion.

To enable the expanding mandrel to be actuated in a remote location, the actuating means will preferably be hydraulic, and able to cause expansion or contraction of the mandrel.

The guide post above the expanding portion of the mandrel is preferably hollow and watertight, so that it acts as buoyancy. Riser pipes requiring connection will vary from 9″ to 22″ diameter, so that the post diameter will vary from 8" to 20". As an example of the advantage offered by including buoyancy, a comparison is made between an air-filled and water-filled steel post of 20" dia.×0.635' wall. In air, the post material weighs 133 lb./ft. In water, this is reduced by the weight of water displaced to 116 lb/ft. With an air-filled post, this material would produce buoyancy of 6 lb./ft. Therefore, considering a post 7 feet long, the weight in water without sealing the bore would be 812 lbs, but when air-filled would provide buoyancy of 42 lbs. After considering the effect of end closures and the expanding mandrel, it is obviously possible to reduce the effective weight from close to 1000 lbs, to less than 50 lbs when immersed.

Steel is the preferred post material due to its high modulus of elasticity which makes a steel guide post rigid, and due to its ready availability.

The effective weight of the guide in water will preferably be less than 150 lbs, more preferably less than 100 lbs and more preferably less than 50 lbs.

The invention includes a process for connecting a tubular member e.g. a riser, to a vertical riser base, e.g. a subsea well head which process comprises suspending the tubular member above the riser base, passing a guide as described above through the bore of the member on a line to below the tubular member, locating the radially expandable portion into the riser base and radially expanding that portion to rigidly attach the guide to the riser base, tensioning the line, lowering the tubular member over the line and the elongate portion of the guide into position for connection to the riser base, actuating means for connecting the tubular member to the riser base, radially contracting the expandable portion of the guide and withdrawing the guide through the tubular member. The invention also includes hydrocarbon e.g. oil obtained from a wellhead through a connection made by the above process or using a guide according to the invention.

A further example of a tubular member which may be installed on a riser base using the method and apparatus of this invention is a blow-out preventer.

DESCRIPTION OF THE DRAWINGS

Figure 1:
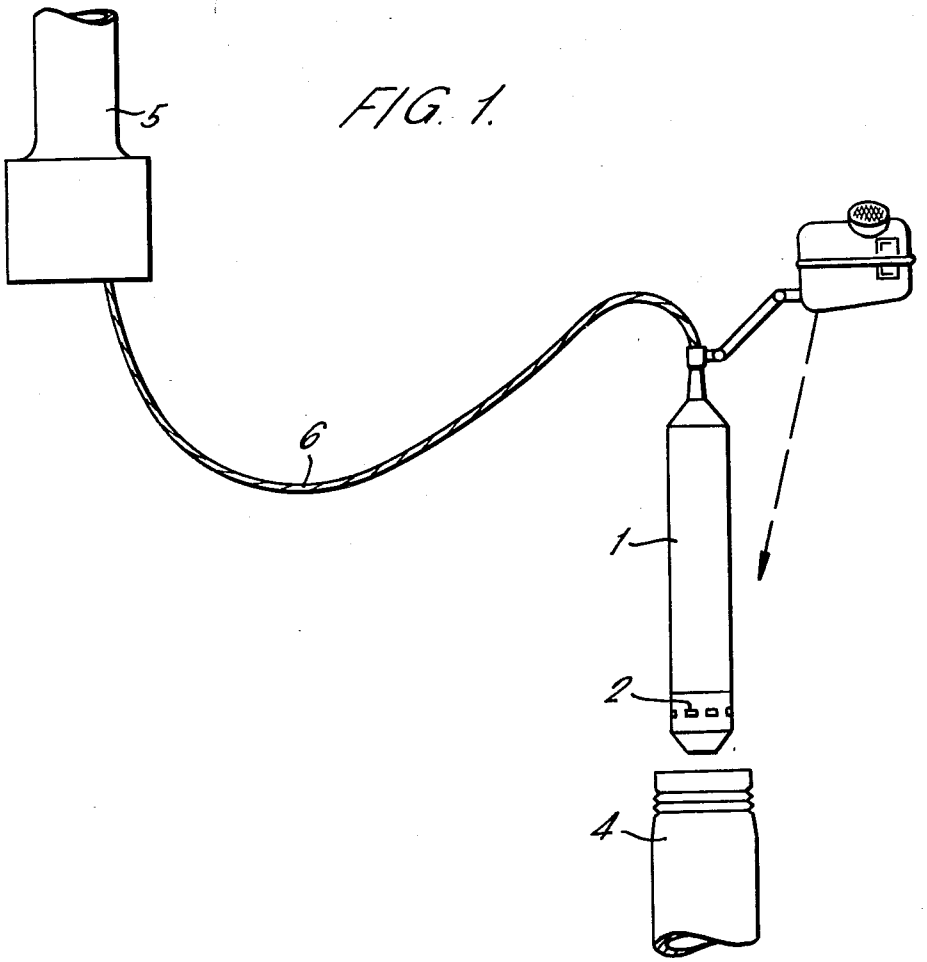

In order that the present invention may be more readily understood, the following description of a specific example is given for illustration, reference being made to the accompanying drawings wherein:

FIG. 1 is a view showing the guide being positioned over the riser base, and

FIG. 2 is a view showing the guide latched into the riser base, tension has been pulled in the cable, and the riser is being lowered.

Figure 3:
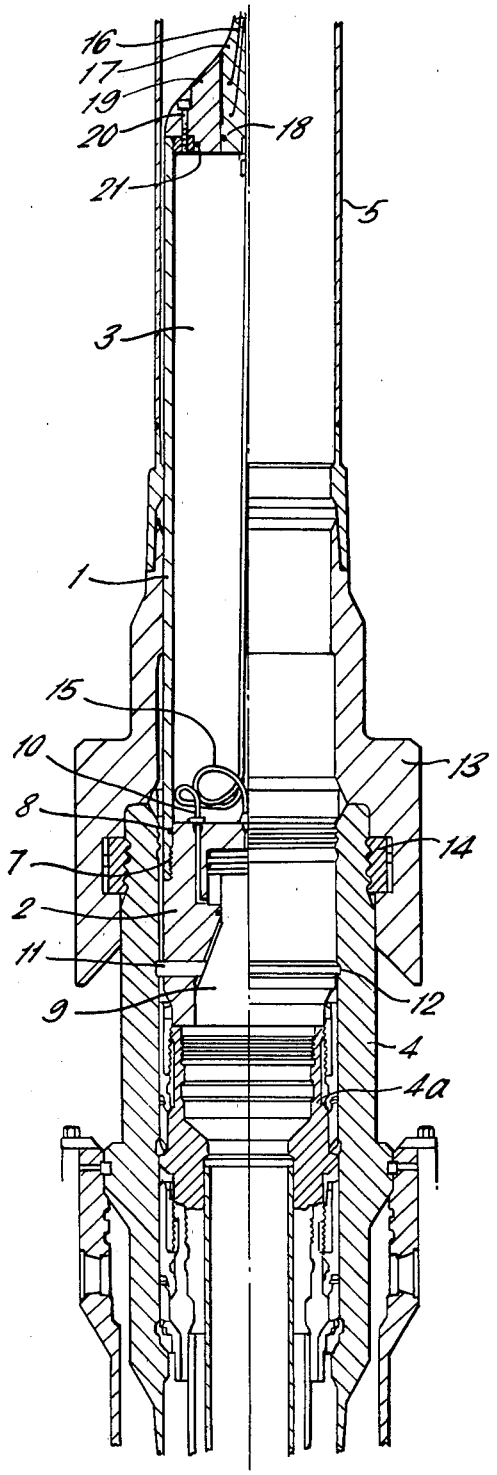

FIG. 3 is a half-sectional view showing on one side the guide latched into the riser base, with the riser pipe lowered over the guide post, and the connection has been made. On the right hand side, the guide has been recovered.

DETAILED DESCRIPTION OF PREFERRED EMBODIMENTS

As shown in FIG. 1 the guide according to the invention includes a guide post 1 having toward one end an expanding latch 2, each end of the post 1 being frusto-conical to aid location in the riser base and riser pipe as described hereafter. The guide is attached on its axis to hydraulic cable 6 on which it is shown being lowered down a riser pipe 5. As shown in FIG. 3, the post 1 has a large sealed cavity 3 full of air which reduces its weight in water to around 50 lbs or less so that a diver or RCV can manoeuvre it laterally. In FIG. 1, an RCV is shown positioning the guide post 1 over a riser base 4, after the post 1 has been lowered down the riser 5 by the cable 6. In the case of a vertically tethered buoyant platform, the freely suspended riser 5 could be laterally offset by a considerable distance (tens of feet) from the seabed mounted riser base 4. A diver or small submersible work system must be able to move the post without difficulty. A large work system is not acceptable as there will usually be a plurality of risers spaced on approximately eight feet centres.

FIG. 2 shows the guide post 1 latched into the riser base 4, and after pulling tension in cable 6 with a surface winch, the riser 5 is being lowered onto the post 1.

The half-section of the post 1 in FIG. 3 shows the detailed construction. Post 1 in this case resting on casing hanger 4a has hollow tubular form with a thread 7 and seal 8 for seabed attachment to the expanding latch mechanism 2 which comprises a hydraulically actuated piston and frusto-conical wedge 9. Pressure applied down hose 10 causes the combined piston and wedge 9 to move upwards thus driving latch members 11 radially outwards into groove 12 of the riser base 4.

When the post 1 is rigidly latched to the riser base 4, tension is pulled in cable 6, and the riser 5 is lowered over the post 1 which guides riser connection 13 into mating contact with the riser base 4. Locking dogs 14 can be actuated hydraulically or mechanically (not shown) to form a rigid connection between the riser 5 and riser base 4.

Pressure applied down hose 15 drives the combined piston and wedge 9 downwards and tension applied to cable 6 causes retraction of latch members 11 to permit recovery of the post 1 to the surface. Latch members may include keys (not shown) to prevent them falling out, or springs (not shown) to assist with retraction. Alternatively, the latch mechanism may be arranged so that springs drive the latch members 11 to an outward position, and a hydraulically driven wedge causes them to retract. Cable 6 has wire re-inforcement 16 over a dual hydraulic hose core which connects with hoses 10 and 15. The wire re-inforcement 16 is embedded into the termination 17 which is sealed by seal 18 to the top cone 19, in turn fixed by screws 20 and sealed by seal 21 to the tubular post 1.

I claim:

1. A guide for use in connecting a tubular member, to a subsea riser base, which guide comprises a guide post, having a reversibly radially expandable portion to locate in and rigidly attach the guide post to the subsea riser base, an elongate portion to be received in the end of the tubular member, and buoyancy means contained within the guide post to reduce the effective weight of the post underwater to a level at which it can be readily manipulated and manoeuvred.

2. A guide as claimed in claim 1 having an effective weight in water not exceeding 150 lbs (68 Kg).

3. A guide as claimed in claim 2 having an effective weight in water not exceeding 50 lbs (23 Kg).

4. A guide as claimed in claim 1 wherein the guide post is of steel.

5. A guide as claimed in claim 1 further comprising an elongate portion rotatable about the axis of the post to be received in the pipe.

6. A guide as claimed in claim 1 wherein the radially expandable portion is remotely actuable.

7. A guide as claimed in claim 6 wherein the radially expandable portion is hydraulically actuable.

8. A guide as claimed in claim 1 bearing a line by which the guide may be suspended with the elongate portion of the guide post uppermost.

9. A guide post as claimed in claim 8 wherein the line is a cable having a hydraulic hose core by means of which cable the radially expandable portion is actuable.

* * * * *